US006390888B1

(12) United States Patent
Amano et al.

(10) Patent No.: US 6,390,888 B1
(45) Date of Patent: May 21, 2002

(54) GRINDER PRESSING DEVICE

(75) Inventors: Yuji Amano, Yamatokoriyama; Yasuhiro Hayakawa, 78, Koaza Mukaiyama, Ooaza Ichisaka, Kizu-cho, Souraku-gun, Kyoto 619-0213, both of (JP)

(73) Assignees: Nitta Corporation; Yasuhiro Hayakawa, both of (JP)

( * ) Notice: Subject to any disclaimer, the term of this patent is extended or adjusted under 35 U.S.C. 154(b) by 0 days.

(21) Appl. No.: 09/600,795

(22) PCT Filed: Jan. 21, 1999

(86) PCT No.: PCT/JP99/00198

§ 371 Date: Aug. 28, 2000

§ 102(e) Date: Aug. 28, 2000

(87) PCT Pub. No.: WO99/37442

PCT Pub. Date: Jul. 29, 1999

(30) Foreign Application Priority Data

Jan. 22, 1998 (JP) ..... 10-010487
Sep. 22, 1998 (JP) ..... 10-268085

(51) Int. Cl.[7] ..... B24B 49/08

(52) U.S. Cl. ..... 451/24; 451/5; 451/11; 451/26; 451/51

(58) Field of Search ..... 451/11, 5, 24, 451/26, 1, 9, 31; 901/9

(56) References Cited

U.S. PATENT DOCUMENTS 5,095,662 A * 3/1992 Grimm et al. ..... 451/51
5,299,389 A * 4/1994 Yonaha et al. ..... 451/5
5,509,847 A * 4/1996 Jinno et al. ..... 451/11
5,565,749 A * 10/1996 Jinno et al. ..... 318/566
5,711,697 A * 1/1998 Taninaga et al. ..... 451/5

FOREIGN PATENT DOCUMENTS

JP 57-178663 * 2/1982 ..... 451/5
JP 60-58841 * 4/1985 ..... 451/5
JP 06-109006 * 4/1994 ..... 451/5

* cited by examiner

*Primary Examiner*—George Nguyen
(74) *Attorney, Agent, or Firm*—Morrison Law Firm

(57) ABSTRACT

A grinder pressing device, wherein either the bottom part of a cylinder main body (10) of an air cylinder (1) in a vertical posture or a piston rod (11) is fixed to a fixed plate (2) and the other one is fixed to a movable plate (3) disposed under the fixed plate (2), either a guide table (G2) or a guide (G1) is mounted on the movable table (3) and the other one is mounted on the outer peripheral surface of the cylinder main body (20) and the guide plate (G2) is guided on the guide (G1) in a vertical direction under the rolling frictional condition through balls and, in the air cylinder (1), a coefficient of friction between the outer peripheral walls of a piston (12) and the piston rod (11) and the structural wall of the cylinder main body (10) is set lower by a metal seal so as to support the piston rod (11) by a ball bush movably in forward and backward directions over an extensive distance, a grinder (G) being mounted on the movable plate (3) and air pressures in upper and lower cylinder chambers (13 and 14) divided by the piston (12) being controlled so as to adjust the pressing force of the grinder (G) to a work to be ground.

17 Claims, 11 Drawing Sheets

GRINDER PRESSING DEVICE

FIELD OF THE INVENTION

The present invention relates to a grinder pressing device.

DESCRIPTION OF THE RELATED ART

Pressing force applied to an object to be ground by a grinder considerably affects grinding performance, grinding accuracy, life of the grindstone, and the like, and therefore grinding operation by a robot is carried out so as to maintain pressing force predetermined by various means.

There are types of grinder device; an electric grinder and an air grinder. In the former grinder, pressing force is controlled by a servomotor by determining pressing force applied to the object by a grindstone according to current of a grinder motor. In the latter grinder, pressing force is controlled by giving a command to a robot by using a six-axis sensor, for example.

However, in such controlling methods of pressing force, both the devices per se are expensive and, especially in the method of giving the command to the robot by using the six-axis sensor, control is complicated.

It is hence an object of the present invention to provide a grinder pressing device which is, irrespective of types of grinder, inexpensive and capable of compensating wear of a grindstone and/or a slight displacement of an object to be ground.

SUMMARY OF THE INVENTION

In a grinder pressing device according to the present invention, one of a bottom portion of a cylinder main body and a piston rod of an air cylinder in a vertical posture is attached to a fixed plate and the other is attached to a movable plate disposed below the fixed plate, one of a guide table and a guide is mounted on a movable plate side and the other is mounted on an outer peripheral face of the cylinder main body. The guide table is guided on the guide in a vertical direction under the rolling frictional condition through balls. In the air cylinder, hermeticity between outer peripheral walls of a piston and the piston rod and a structural wall of the cylinder main body side is provided by metal seals and friction coefficients between the walls is set low, and the piston rod is supported by a ball bushing in a large area so as to be movable forward and backward. A grinder is mounted to the movable plate directly or through another member, and pressing force of the grinder to an object to be ground can be controlled by adjusting air pressure of upper and lower cylinder chambers separated by the piston.

Moreover, a grinder pressing device of the present invention includes a hanging member having a grinder mounting portion and a partition plate, upper and lower bellows cylinders fixedly disposed on upper and lower faces of the partition plate, and a retaining member for maintaining a constant distance between an upper face of the upper bellows cylinder and a lower face of the lower bellows cylinder. The grinder pressing device is used in a manner that the retaining member is fixed to a fixed portion F or a robot output portion, that a grinder is provided on the grinder mounting portion, and that the upper and lower bellows cylinders are supplied with air of respectively predetermined pressure.

PREFERRED EMBODIMENTS OF THE PRESENT INVENTION

The present invention is described in detail in conjunction with the accompanying drawings.

[Embodiment 1]

Figure 1:
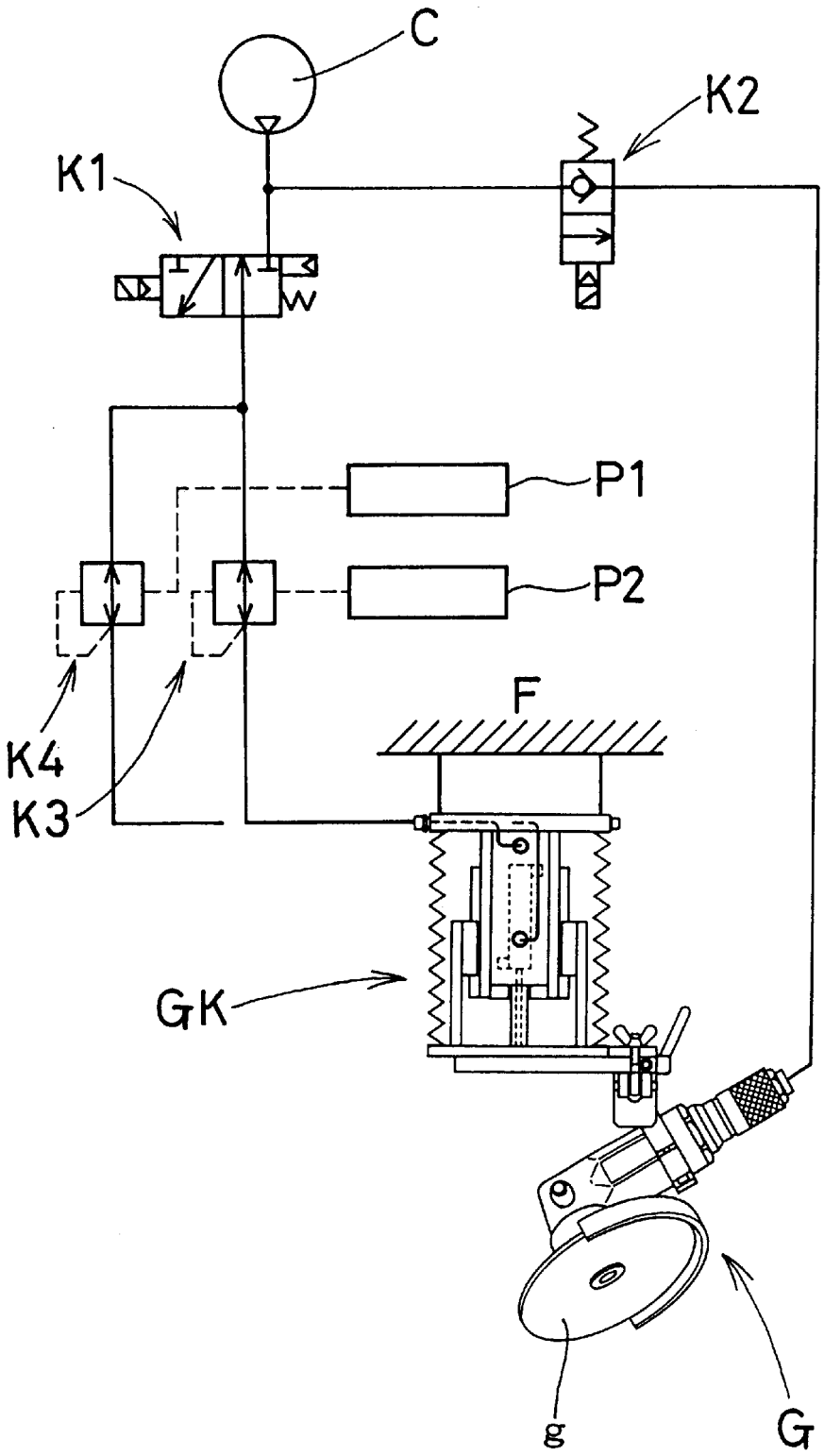
FIG. 1 is an explanatory view showing an air circuit of a grinding system using a grinder pressing device in Embodiment 1 of the present invention.

As shown in FIG. 1, the grinding system of this embodiment includes a grinder pressing device GK for supporting a grinder G and a compressor C for driving the grinder G to rotate and sending air to the grinder pressing device GK. Selector valves K1, K2, electro-pneumatic proportional valves K3, K4, and pressure sensors P1, P2 are provided to air lines connecting the compressor C and the grinder G or the grinder pressing device GK.

Main structural portions of this grinding system will be described below.

The grinder G shown in FIG. 1 is an air-type grinder in which a grindstone g is driven to rotate by compressed air from the compressor C and compressed air is fed through the above selector valve K2.

Figure 2:
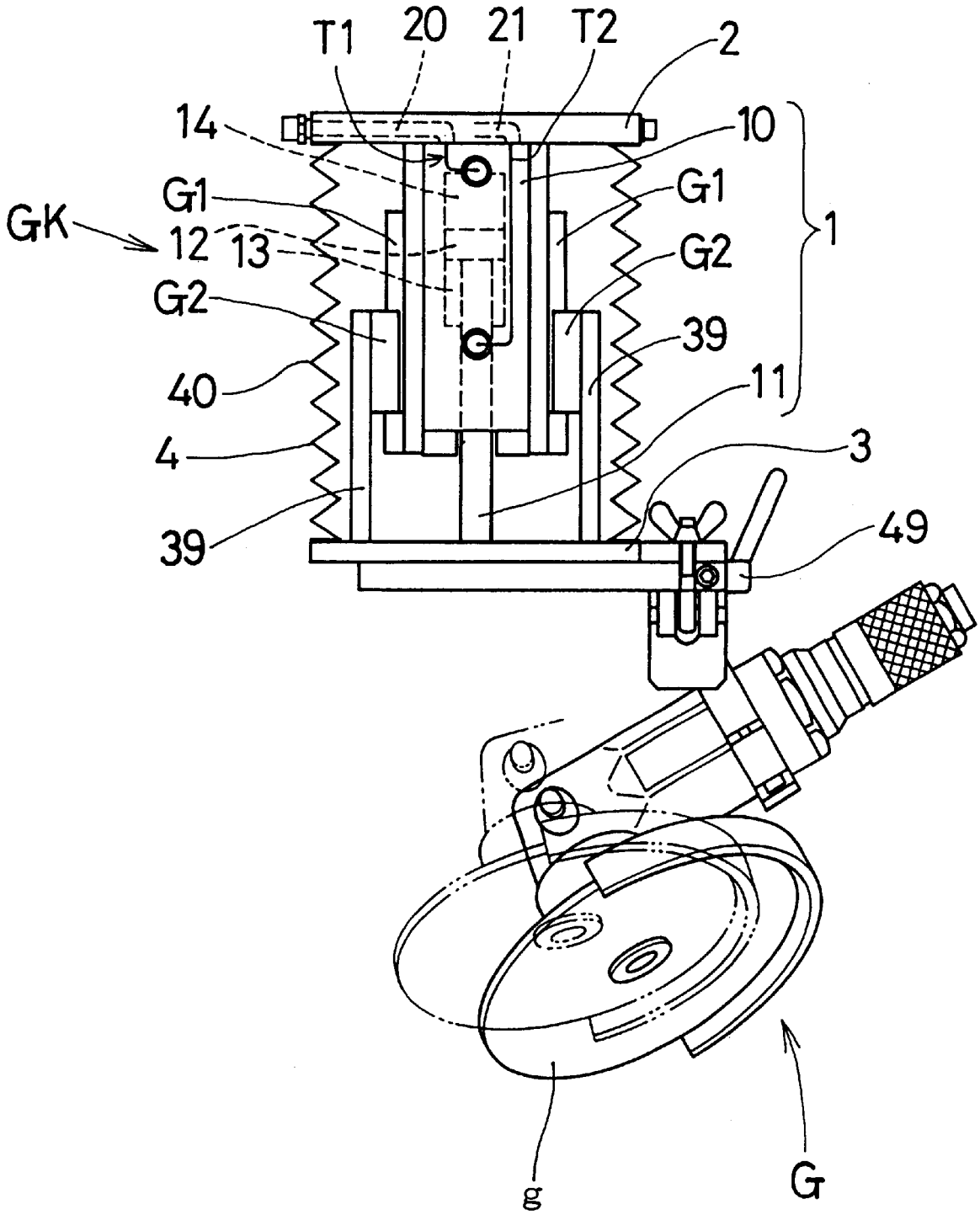
FIG. 2 is a front view of a grinder, the grinder pressing device and the like forming the grinding system.
Figure 3:
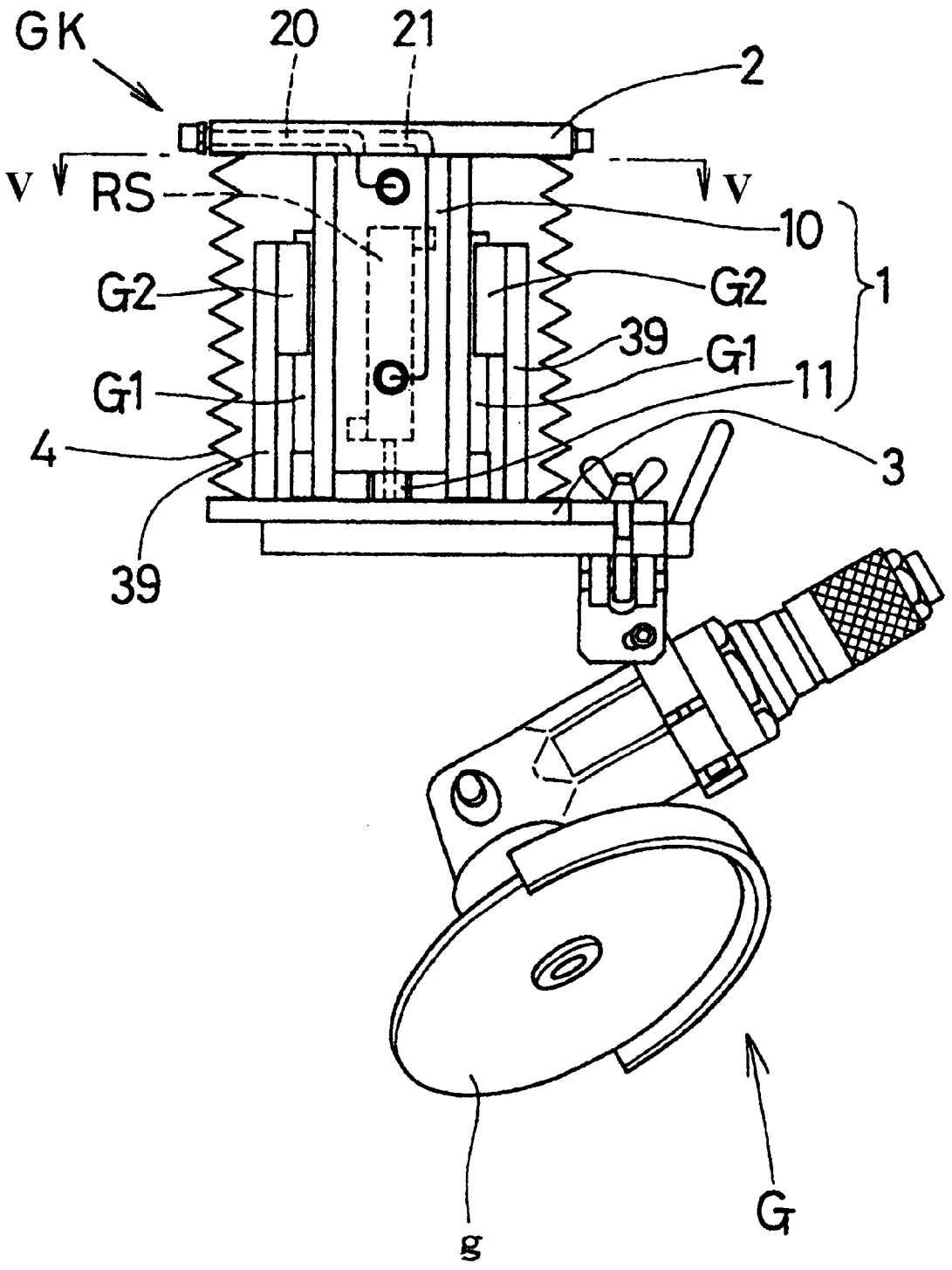
FIG. 3 is a front view in which a piston rod of an air cylinder in the grinder pressing device is put in a contracted state from the state shown in FIG. 2.
Figure 4:
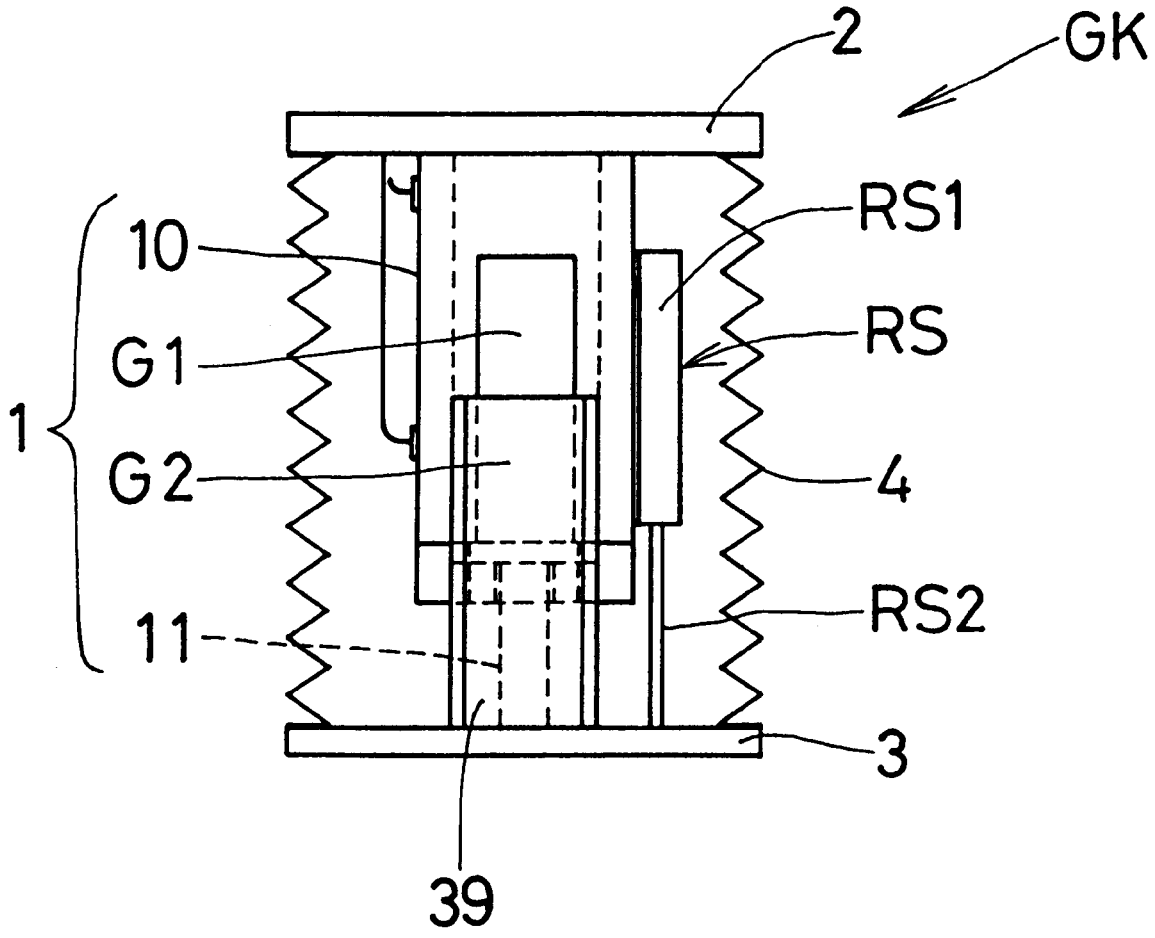
FIG. 4 is a side view of the grinder pressing device.
Figure 5:
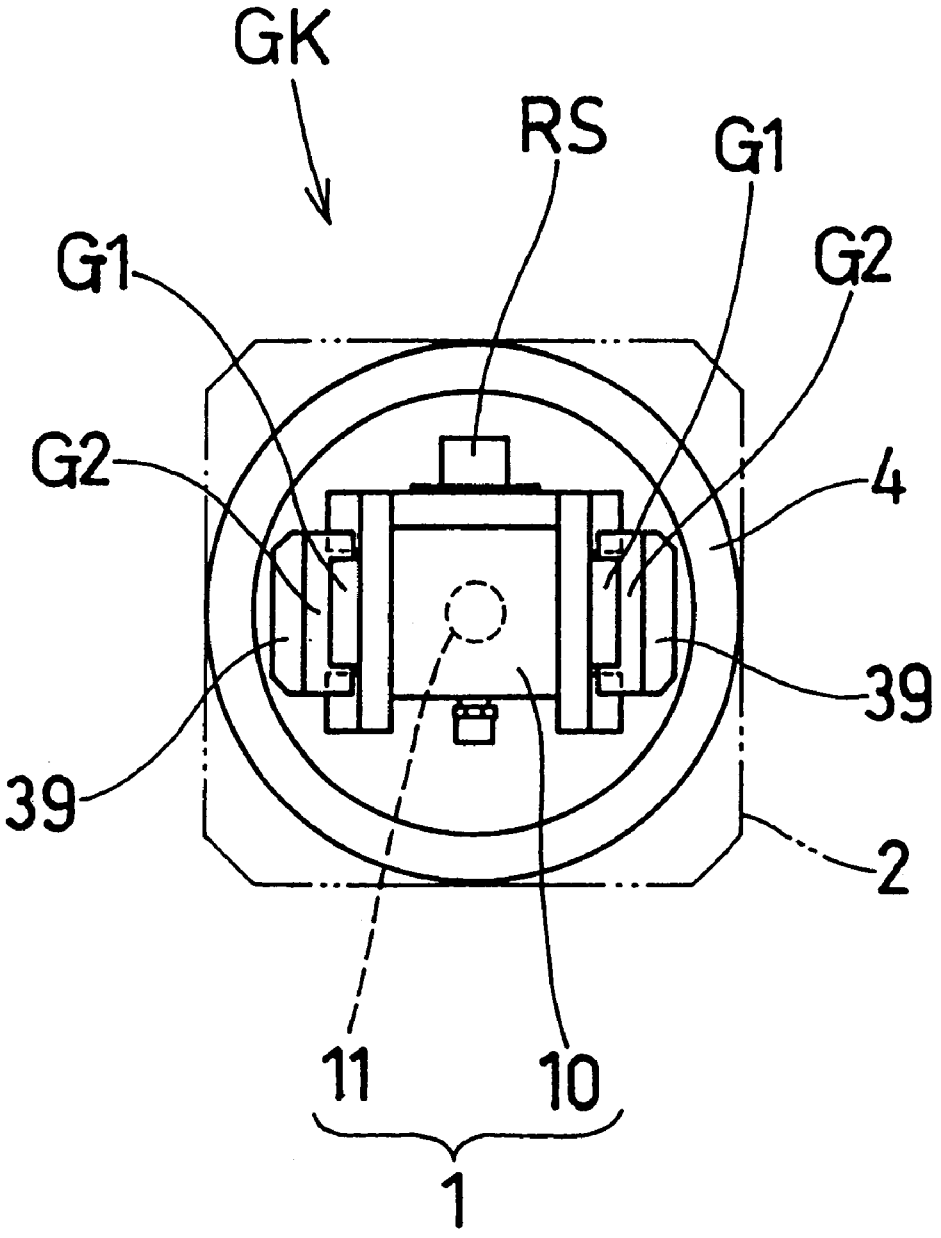
FIG. 5 is a sectional view taken along a line V—V in FIG. 3.
Figure 6:
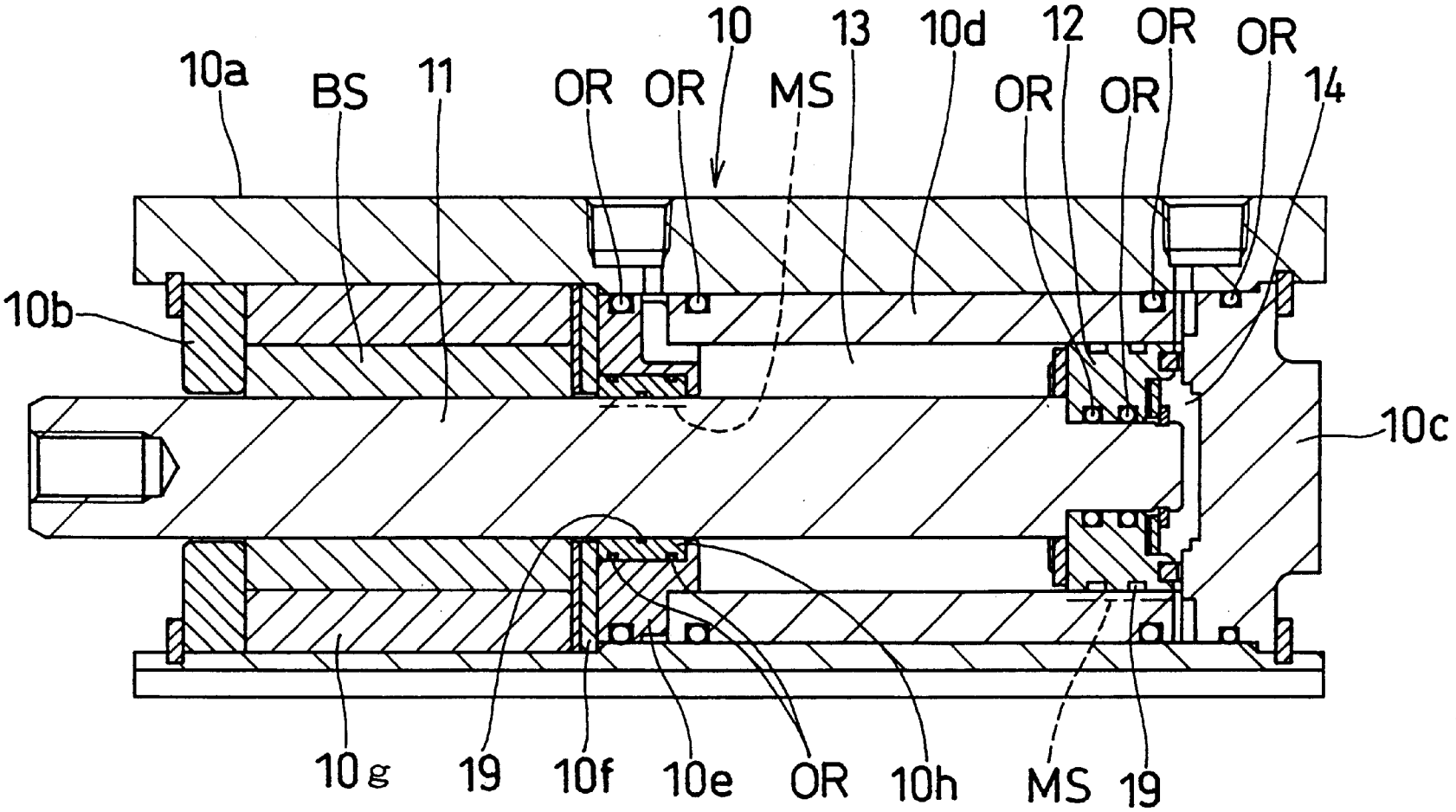
FIG. 6 is an explanatory view of the air cylinder in the grinder pressing device.
Figure 7:
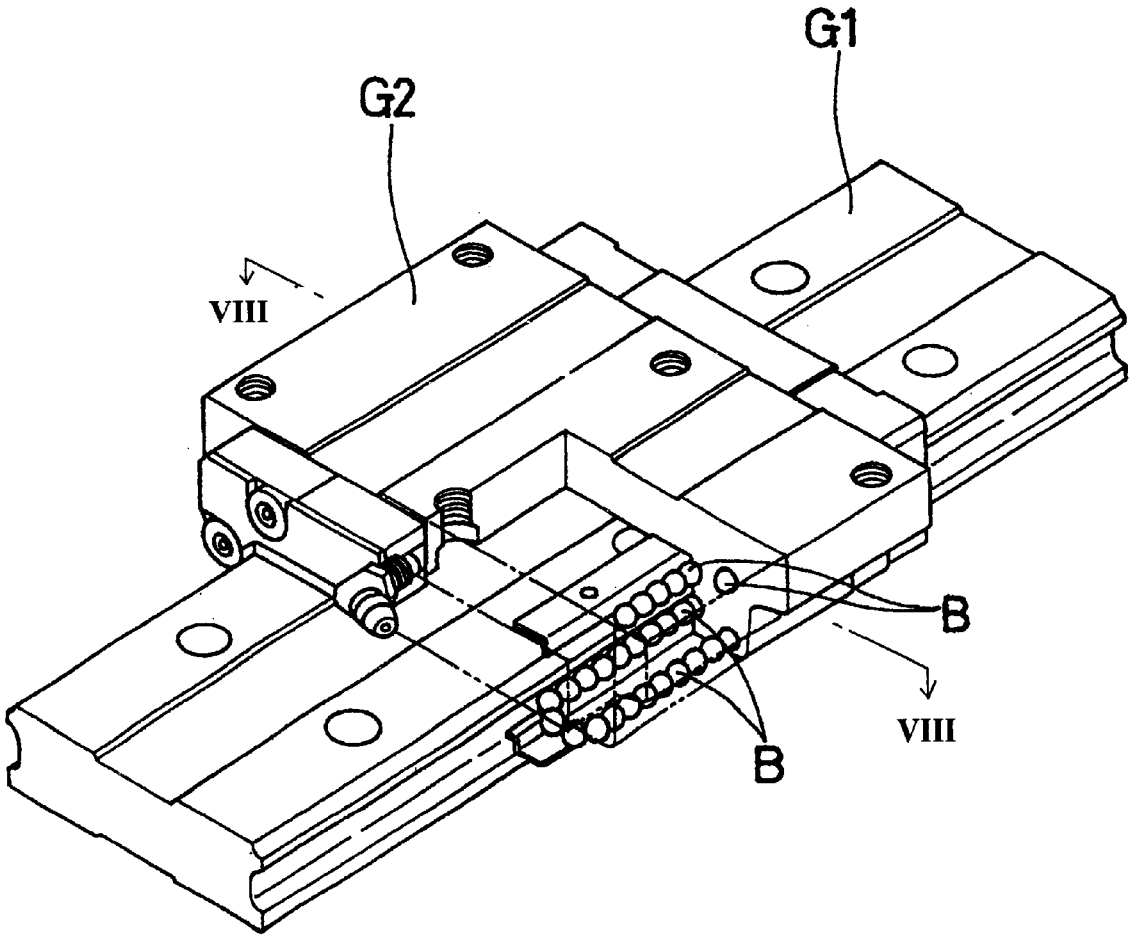
FIG. 7 is a partially sectional perspective view of a device formed by combining a guide and a guide table used for the grinder pressing device.
Figure 8:
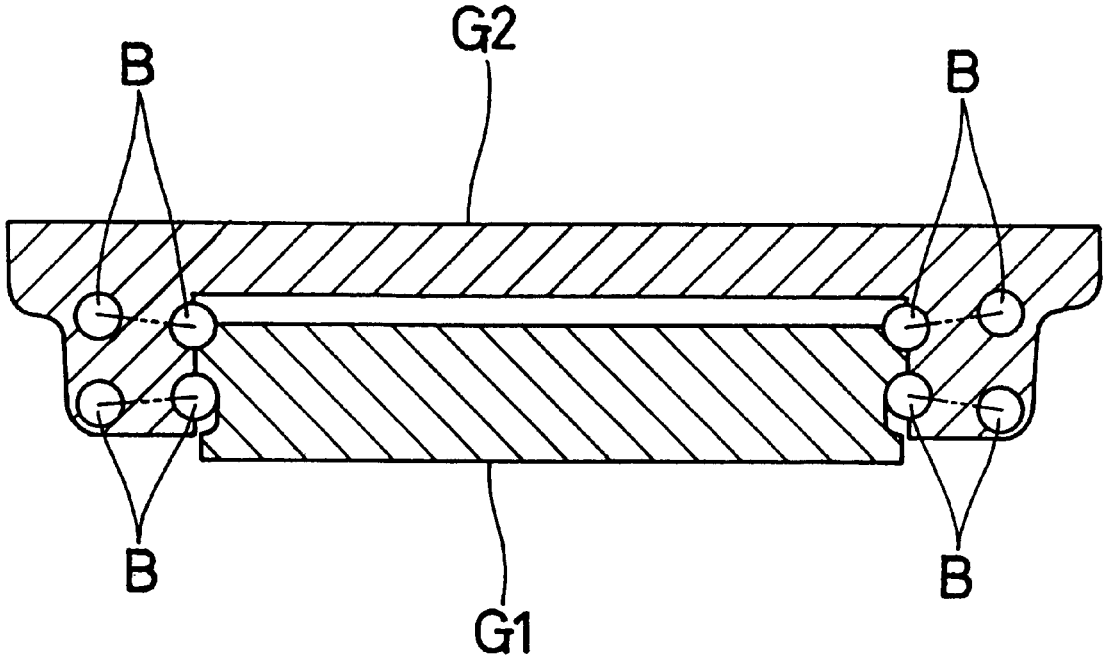
FIG. 8 is a sectional view of the device formed by combining the guide and the guide table taken along line VIII—VIII in FIG. 7.

In the grinder pressing device GK, as shown in FIGS. 2 and 3, a bottom portion of a cylinder main body 10 of an air cylinder 1 in a vertical posture is fixed to a fixed plate 2, and a movable plate 3 is attached to an end portion of a piston rod 11 of the air cylinder 1. A guide table G2 is mounted to the movable plate 3 side, and a guide G1 is mounted on an outer peripheral face of the cylinder main body 10. As shown in FIGS. 7 and 8, the guide table G2 is guided on the guide G1 in a vertical direction under the rolling frictional condition through balls B (steel balls). As shown in FIGS. 3 to 5, the grinder pressing device GK has a linear sensor RS for detecting a position of the movable plate 3 with respect to the fixed plate 2 so that a position of the grinder G can be detected, and further a dust-proof bellows pipe 4 surrounding parts and members present between the fixed plate 2 and the movable plate 3. As shown in FIGS. 2 and 6, by adjusting air pressures in upper and lower cylinder chambers 13 and 14 separated by a piston 12, pressing force applied to an object to be ground by the grindstone g of the grinder G fixed to the movable plate 3 through a mounting plate 49 can be adjusted.

As shown in FIG. 6, the air cylinder 1 is basically formed with the cylinder main body 10, the piston 12 for dividing an inside of the cylinder main body 10 into the cylinder chambers 13 and 14, and the piston rod 11 connected to the piston 12. Supply and discharge of air to and from the cylinder chambers 13 and 14 cause the piston 12 to move to change a projecting portion of the piston rod 11 from the cylinder main body 10. In this Embodiment, as shown in FIG. 6, the cylinder main body 10 is formed by combining members 10*a* to 10*h* and the like, and O-rings OR are disposed between the members where hermeticity is required.

In this air cylinder 1, as shown in FIG. 6, airtightness is provided by metal seals MS between an outer peripheral wall of the piston 12 and an inner peripheral wall of the member 10*d* and between an outer peripheral wall of the piston rod 11 and an inner peripheral wall of the member 10*h* so as to set friction coefficients between the walls low. The piston rod 11 is supported by a ball bushing BS in a large area of the piston rod 11 so that the piston rod 11 can move forward and backward. Reference numeral 19 in FIG. 6 denotes a grease groove.

The fixed plate 2 has two air lines 20 and 21 extending from a side face to a lower face of the fixed plate 2 as shown in FIGS. 2 and 3 and is attached to the fixed portion F through another member as shown in FIG. 1.

As shown in FIGS. 1 and 2, air that has passed through the electro-pneumatic proportional valve K3 is supplied to the cylinder chamber 14 through the air line 20 and a tube Tl, while air that has passed through the electro-pneumatic proportional valve K4 is supplied to the cylinder chamber 13 through the air line 21 and a tube T2.

The movable plate 3 and the mounting plate 49 are united with each other with a bolt and the like, and, as shown in FIG. 2, the grinder G is attached to the mounting plate 49 in a manner that a posture of the grinder G can be changeable.

The bellows pipe 4 is made of rubber material and, as shown in FIG. 2, core wires are embedded in outer peripheral sharp portions 40 so that the bellows pipe 4 has very small expansion-contraction resistance and shape retention in a diameter direction. A part of the bellows pipe 4 in this Embodiment takes the form of mesh through which air can come into and go out of the bellows pipe 4.

The guide G1 and the guide table G2 are assembled with each other through balls B as shown in FIGS. 7 and 8. When the guide table G2 moves on the guide G1, the balls rotatively circulate. The balls B have angular-contact structure of 45° with respect to the guide G1 and are applied with well-balanced preload. Therefore, the balls B have the same rated load in vertical and horizontal directions and maintain a constantly low coefficient of rolling friction.

As shown in FIGS. 2 and 3, the guide G1 is mounted on an outer face of the cylinder main body 10 of the air cylinder 1 in a vertical posture and the guide table G2 is mounted on a bracket 39 erectly provided on the movable plate 3. A range of movement of the guide table G2 with respect to the guide G1 is determined by upper-limit and lower-limit stoppers.

The linear sensor RS detects a position of the movable plate 3 with respect to the fixed plate 2 in order to detect a position of the grinder G, as described above. As shown in FIGS. 4 and 5, the linear sensor RS is disposed in a manner that a main body RS1 thereof is mounted to the cylinder main body 10 and a rod RS2 thereof is mounted on the movable plate 3. The rod RS2 of the linear sensor RS is movable with small resistance to the main body RS1.

With the structure of the grinder pressing device GK as stated above, air pressure to the cylinder chambers 13 and 14 can be adjusted by changing voltage or current to the electro-pneumatic proportional valves K3 and K4. As a result, the pressing force of the grindstone g to the object to be ground can be set at a desired value.

In the air cylinder 1 used for the grinder pressing device GK, friction coefficients between the outer peripheral wall of the piston 12 and the inner peripheral wall of the member 10*d* and between the outer peripheral wall of the piston rod 11 and the inner peripheral wall of the member 10*h* are respectively set low, and the piston rod 11 is supported by a ball bushing BS in a large area of the piston rod 11 so that the piston rod 11 can move forward and backward. Therefore, the pressing force of the grindstone g to the object to be ground can be compensated irrespective of wear of the grindstone g or a slight displacement of the object to be ground.

Furthermore, use of the grinder pressing device GK eliminates an expensive device and enables very easy control, thereby cost being lowered.

In this Embodiment 1, design modifications of the following (1) to (6) may be made.

(1) In the above Embodiment, the vertical movement of the grinder G and the pressing force of the grindstone g to to the object to be ground are set by changing internal pressures in the cylinder chambers 13 and 14 of the air cylinder 1 by using the two electro-pneumatic proportional valves K3 and K4. Alternatively, air pressure fed to one of the cylinder chambers 13 and 14 is fixed while air pressure fed to the other is variable.

(2) In a system in which the grindstone g presses the object to be ground while the object being moved vertically, both of the air pressures fed to the cylinder chambers 13 and 14 of the air cylinder 1 may be fixed.

(3) The grinder G used in the system of the above Embodiment is an air type one. However, an electric grinder may be selectively employed in the system.

(4) The grinder G is, although not limited thereto, attached to the fixed portion F through the grinder pressing device GK in the system of the above Embodiment. Optionally, for example, the grinder G may be attached to an output portion of a robot through the grinder pressing device GK.

(5) Different from the above Embodiment, the end portion of the piston rod 11 of the air cylinder 1 in the vertical posture may be fixed to the fixed plate 2 and a bottom portion of the cylinder main body 10 may be mounted on the movable plate 3 to form the grinder pressing device GK.

(6) Different from the above Embodiment, the guide G1 may be attached to the movable plate 3 side and the guide table G2 may be mounted on the outer peripheral face of the cylinder main body 10.

[Embodiment 2]

Figure 9:
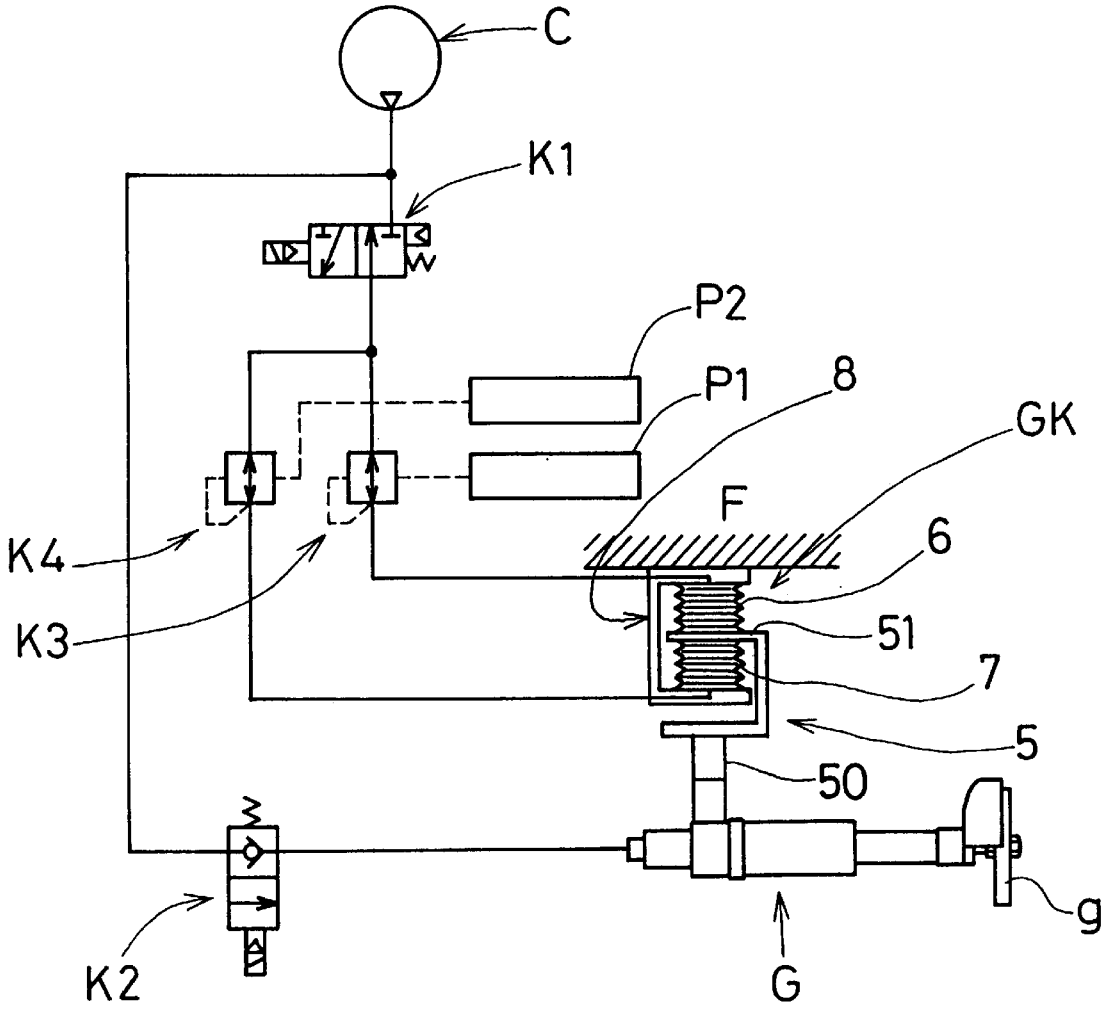
FIG. 9 is an explanatory view showing an air circuit of a grinding system using a grinder pressing device in Embodiment 2 according to the present invention.
Figure 10:
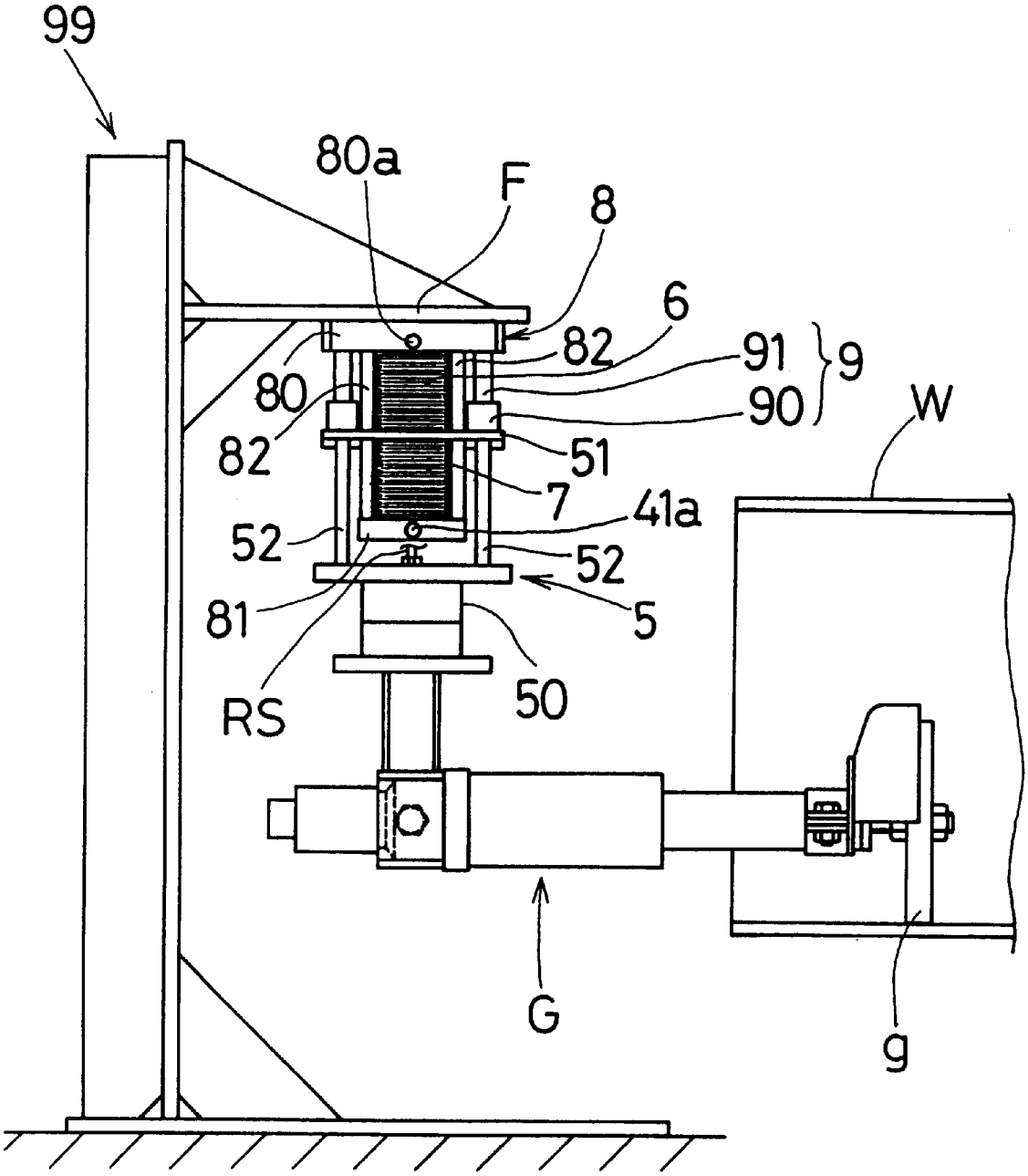
FIG. 10 is a front view of the grinder, the grinder pressing device and the like forming the grinding system in Embodiment 2 of present invention.

The grinding system in this Embodiment, as shown in FIG. 9, includes a grinder G, a grinder pressing device GK for supporting the grinder G, a compressor C for driving the grinder G to rotate and feeding air to the grinder pressing device GK, and further as shown in FIG. 10, a frame 99 (corresponding to the fixed portion F) for supporting the grinder pressing device GK. Selector valves K1 and K2, electro-pneumatic proportional valves K3 and K4, and pressure sensors P1 and P2 are provided to air lines connecting the compressor C and the grinder G or the grinder pressing device GK.

Main structural portions of the grinding system will be described below.

As shown in FIG. 9, an air-type grinder in which compressed air from the compressor C drives a grindstone g to rotate is employed as the grinder G. The compressed air is fed through the above selector valve K2.

Figure 11:
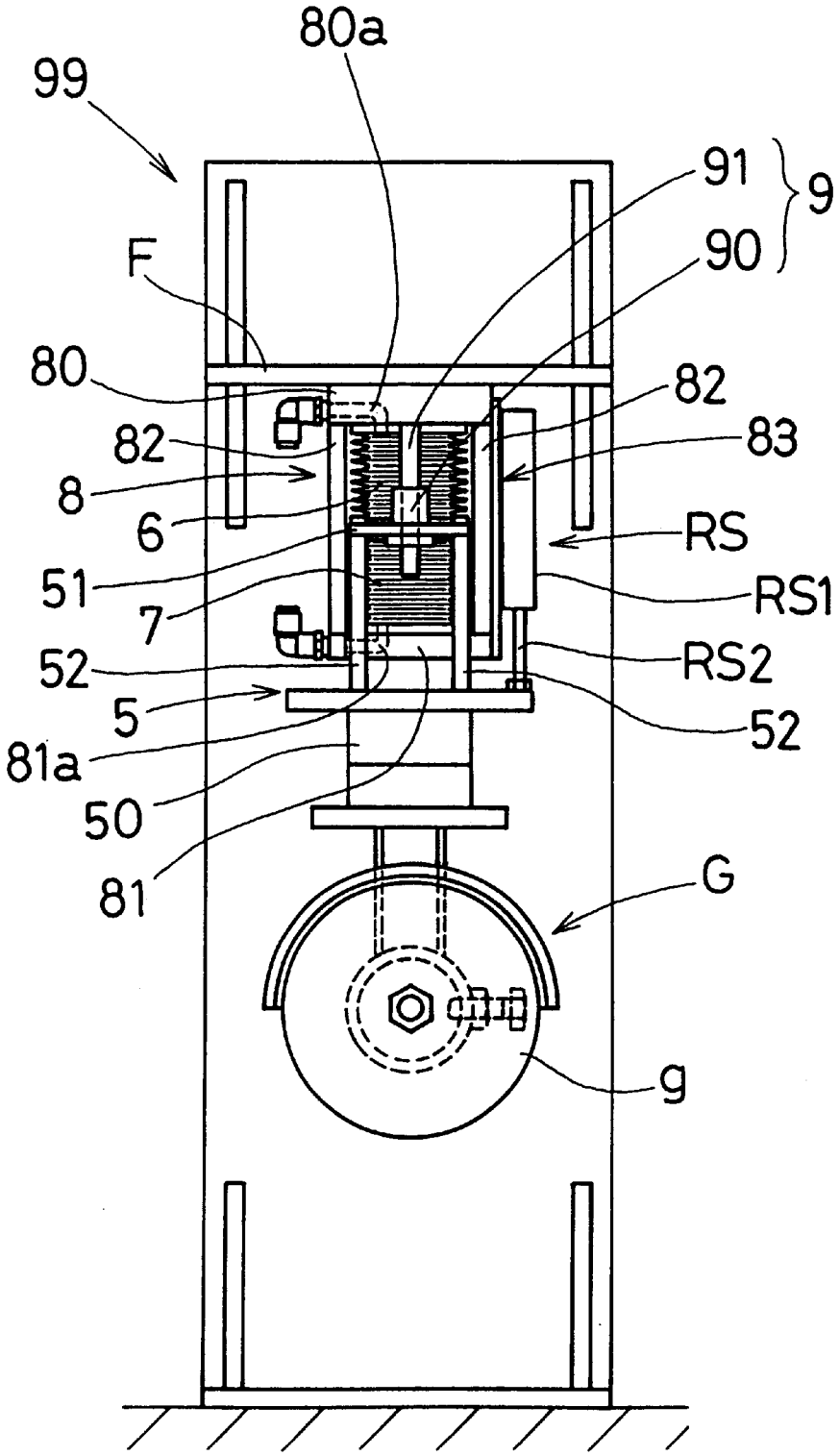
FIG. 11 is a side view of the grinder, the grinder pressing device and the like forming the grinding system in Embodiment 2 of present invention.

As shown in FIGS. 10 and 11, the grinder pressing device GK has a hanging member 5 on which the grinder G is hung, upper and lower bellows cylinders 6 and 7 fixedly disposed on upper and lower faces of a partition plate 51 of the hanging member 5 that will be described later, a retaining member 8 for maintaining a constant distance between an upper face of the upper bellows cylinder 3 and a lower face of the lower bellows cylinder 7, a linear sensor RS for detecting a position of the grinder G, and a guide mechanism 9 for allowing the grinder G to move smoothly and vertically with keeping its posture.

As shown in FIGS. 10 and 11, the hanging member 5 is formed by connecting a grinder mounting portion 50 and the partition plate 51 by four connecting bars 52.

As shown in FIGS. 10 and 11, the retaining member 8 includes a thick upper plate 80, a thick lower plate 81, and four connecting bars 82 which connect the upper and lower plates 80 and 81.

The upper and lower bellows cylinders 6 and 7 are formed by closing opposite end faces of bellows pipes with plate members. As shown in FIGS. 10 and 11, the upper bellows cylinder 6 is fixedly disposed between the upper plate 80 and the partition plate 51 and the lower bellows cylinder 7 is between the partition plate 51 and the lower plate 81. As shown in FIGS. 10 and 11, air from the compressor C can be supplied respectively to the upper bellows cylinder 6 through an air line 80a formed in the upper plate 80 and to the lower bellows cylinder 7 through an air line 81*a* formed in the lower plate 81. The upper bellows cylinder 6 may be formed by closing the opposite end faces of the bellows pipe with the upper plate 80 and the partition plate 51 and the lower bellows cylinder 7 may be formed by closing the opposite end faces of the bellows pipe with the partition plate 51 and the lower plate 81.

As shown in FIG. 11, the linear sensor RS includes a main body RS1 provided on a plate 83 hung across between the connecting bars 82 and 82, and a rod RS2 provided on an upper face portion of the grinder mounting portion 50 at its end portion. The position of the grinder G can be detected according to forward and backward movement of an input shaft portion 51 due to vertical movement of the grinder G. In a state in which the grindstone g is pressed against an object W to be ground, in order to cancel elastic returning force of the upper and lower bellows cylinders 6 and 7 generated when a position of the grinder G is shifted from a preset position, air pressure supplied to one of the upper and lower bellows cylinders 6 and 7 is changed by the electro-pneumatic proportional valve in response to output information of the linear sensor RS that has detected the position of the grinder G, thereby wear of the grindstone g or a slight displacement of the object W to be ground being compensated.

As shown in FIGS. 10 and 11, the guide mechanism 9 includes a bearing portion 90 mounted on the partition plate 51 and a shaft portion 91 hung from the upper plate 80. The shaft portion 91 is closely and slidably inserted into a bore in the bearing portion 90. Therefore, weight of the grinder G produces moment on the partition plate 51. However, the partition plate 51 moves vertically while maintaining a horizontal state and the posture of the grinder G is not affected by the moment.

With the above structure of the grinder pressing device GK, the device GK has the following functions.

In order to move the grinder G upward, voltage or current to the electro-pneumatic proportional valves K3 and K4 is changed so as to make the internal pressure of the lower bellows cylinder 3 higher than that of the upper bellows cylinder 6. In order to bring the grindstone g of the grinder G into contact with the object W to be ground, the voltage or the current to the electro-pneumatic proportional valve K3 is reduced so as to gradually lower the internal pressure of the lower bellows cylinder 7.

In the grinding process of the object W by the grindstone g of the grinder G, a constant relationship between the internal pressures of the upper bellows cylinder 6 and the lower bellows cylinder 7 is maintained to make the pressing force of the grindstone g to the object W to be ground constant. In case the pressing force is made constant as described above, regardless of wear of the grindstone g or a slight displacement of the object W to be ground, the pressing force applied to the object W to be ground by the grindstone g is compensated by the linear sensor RS and the like.

Furthermore, in this grinder pressing device GK, it is possible to know the position of the grinder G by the linear sensor RS and the like and to detect when to replace the grindstone g. Under the grinding process of the object W, an overload can be detected by the pressure sensors P1 and P2. Moreover, the grinder pressing device GK in this Embodiment necessitates no expensive device and enables very easy control, thereby resulting in a lower cost.

In this Embodiment, design modifications of the following (1) to (6) may be made.

(1) In the above Embodiment, in the state in which the grindstone g is pressed against the object W to be ground, in order to cancel the elastic returning force of the upper and lower bellows cylinders 6 and 7 generated when the position of the grinder G is shifted from the preset position, air pressure supplied to one of the upper and lower bellows cylinders 6 and 7 is changed by the electro-pneumatic proportional valve in response to the output information of the linear sensor RS that has detected the position of the grinder G. However, such a system is not required in case elastic moduli of the upper and lower bellows cylinders 6 and 7 are set to small values. This is because the elastic returning force of the upper and lower bellows cylinders 6 and 7 generated when the position of the grinder G is shifted from the preset position are extremely small as compared with the pressing force of the grindstone g to the object W to be ground.

(2) In the above Embodiment, vertical movement of the grinder G and pressing force of the grindstone g to the object W to be ground are set by changing the internal pressures in the upper and lower bellows cylinders 6 and 7 by using the two electro-pneumatic proportional valves K3 and K4. Alternatively, a system can be employed in which air pressure fed to one of the upper and lower bellows cylinders 6 and 7 is fixed while air pressure fed to the other is variable.

(3) In a system in which the object W to be ground is moved vertically and the grindstone g is pressed against the object W, air pressures respectively fed to the upper and lower bellows cylinders 6 and 7 may be fixed.

(4) The grinder G used for the system in the above Embodiment is an air type grinder. However, this system may be applied to an electric grinder.

(5) In the system of the above Embodiment, the grinder G m is, although not limited thereto, attached to the fixed portion F, or the frame 99, through the grinder pressing device GK. Alternatively, for example, the grinder G may be attached to an output portion of a robot through the grinder pressing device GK.

INDUSTRIAL APPLICABILITY

As stated above, the grinder pressing device according to the present invention is, regardless of types of grinder, inexpensive and suitable for grinding a portion where wear of the grindstone and the slight displacement of the object to be ground have to be compensated.

What is claimed is:

1. A grinder pressing device comprising an air cylinder (1) in a vertical posture, a guide table (G2) and a guide (G1), wherein one of a bottom portion of a cylinder main body (10) and a piston rod (11) of said air cylinder (1) is fixed to a fixed plate (2) and other is mounted to a movable plate (3) disposed below said fixed plate (2), one of said guide table (G2) and said guide (G1) is mounted to a movable plate (3) side and other is mounted on an outer peripheral face of said cylinder main body (10), said guide table (G2) is guided on said guide (G1) in a vertical direction under a rolling frictional condition through balls (B), said air cylinder (1) is formed in a manner that hermeticity is provided by metal seals (MS) between outer peripheral walls of a piston (12) and said piston rod (11) and a structural wall of said cylinder main body (10) side so as to set friction coefficients between said walls low and that said piston rod (11) is supported by a ball bushing (BS) in a large area to move forward and backward, said movable plate (3) is provided directly or through another member with a grinder (G), and pressing force applied to an object to be ground by said grinder (G) can be controlled by adjusting air pressure of upper and lower cylinder chambers (13, 14) separated by said piston (12).

2. A grinder pressing device according to claim 1, wherein a linear sensor (RS) for detecting a position of said movable plate (3) with respect to said fixed plate (2) is provided so as to detect a position of said grinder (G).

3. A grinder pressing device according to claim 2, wherein a main body (RS1) side of said linear sensor (RS) is mounted on said cylinder main body (10) and a shaft portion (RS2) of said linear sensor (RS) is mounted on said movable plate (3).

4. A grinder pressing device according to claim 1, wherein a dust-proof bellows pipe (4) for surrounding a part and a member disposed between said fixed plate (2) and said movable plate (3) is provided and expansion-contraction resistance of said bellows pipe (4) is set very small.

5. A grinder pressing device comprising a hanging member (5) having a grinder mounting portion (50) and a partition plate (51), upper and lower bellows cylinders (6)(7) fixedly disposed on upper and lower faces of said partition plate (51), and a retaining member (8) for maintaining a constant distance between an upper face of said upper bellows cylinder (6) and a lower face of said lower bellows cylinder (7), wherein said retaining member (8) is mounted to one of a fixed portion (F) and a robot output portion, said grinder mounting portion (50) is provided with a grinder (G), and said upper and lower bellows cylinders (6)(7) are supplied with air of respectively predetermined pressures.

6. A grinder pressing device according to claim 5, wherein said upper and lower bellows cylinders (6)(7) are respectively supplied with air so as to cause lifting force to act on said partition plate (51) of said hanging member (5).

7. A grinder pressing device according to claim 5 , wherein at least one of air pressures supplied respectively to said upper and lower bellows cylinders (6)(7) is changeable.

8. A grinder pressing device according to claim 5, wherein at least one of air pressures supplied to said upper and lower bellows cylinders (6)(7) is changeable in response to output information of a linear sensor (RS) for detecting a position of said grinder (G) so as to cancel elastic returning force of said upper and lower bellows cylinders (6)(7) generated when said position of said grinder (G) in a state in which a grindstone (g) is pressed against an object (W) to be ground is shifted from a predetermined position.

9. A grinder pressing device according to claim 7, wherein at least one of air pressures supplied to said upper and lower bellows cylinders (6)(7) is changeable in response to output information of a linear sensor (RS) for detecting a position of said grinder (G) so as to cancel elastic returning force of said upper and lower bellows cylinders (6)(7) generated when a position of said grinder (G) in a state in which a grindstone (g) is pressed against an object (W) to be ground is shifted from a predetermined position.

10. A grinder pressing device according to claim 8, wherein when said linear sensor (RS) outputs information that a position of said grinder (G) is shifted more than a certain amount from said predetermined position, a warning means is put into an output state or said grinder (G) is set to stop.

11. A grinder pressing device according to claim 9, wherein when said linear sensor (RS) outputs information that a position of said grinder (G) is shifted more than a certain amount from said predetermined position, a warning means is put into an output state or said grinder (G) is set to stop.

12. A grinder pressing device according to claim 5, wherein said upper and lower bellows cylinders (6)(7) have a same diameter and are disposed on a same vertical axis.

13. A grinder pressing device according to claim 7, wherein said upper and lower bellows cylinders (6)(7) have a same diameter and are disposed on a same vertical axis.

14. A grinder pressing device according to claim 8, wherein said upper and lower bellows cylinders (6)(7) have a same diameter and are disposed on a same vertical axis.

15. A grinder pressing device according to claim 9, wherein said upper and lower bellows cylinders (6)(7) have a same diameter and are disposed on a same vertical axis.

16. A grinder pressing device according to claim 10, wherein said upper and lower bellows cylinders (6)(7) have a same diameter and are disposed on a same vertical axis.

17. A grinder pressing device according to claim 11, wherein said upper and lower bellows cylinders (6)(7) have a same diameter and are disposed on a same vertical axis.

* * * * *